US012378053B2

(12) United States Patent
Schüttfort

(10) Patent No.: US 12,378,053 B2
(45) Date of Patent: Aug. 5, 2025

(54) METHOD AND DEVICE FOR PRODUCING A BLISTER TUBE, AND BLISTER TUBE

(71) Applicant: Becton Dickinson Rowa Germany GmbH, Kelberg (DE)

(72) Inventor: Torben Schüttfort, Sassen (DE)

(73) Assignee: Becton Dickinson Rowa Germany GmbH, Kelberg (DE)

( * ) Notice: Subject to any disclaimer, the term of this patent is extended or adjusted under 35 U.S.C. 154(b) by 0 days.

(21) Appl. No.: 18/664,808

(22) Filed: May 15, 2024

(65) Prior Publication Data

US 2024/0300717 A1 Sep. 12, 2024

Related U.S. Application Data

(63) Continuation of application No. 17/093,332, filed on Nov. 9, 2020, now Pat. No. 12,043,464.

(51) Int. Cl.
*B65D 75/36* (2006.01)
*B65B 5/02* (2006.01)
(Continued)

(52) U.S. Cl.
CPC ..... *B65D 75/36* (2013.01); *B65B 5/02* (2013.01); *B65B 5/04* (2013.01); *B65B 47/00* (2013.01); *B65B 61/26* (2013.01); *B65D 65/40* (2013.01)

(58) Field of Classification Search
CPC .. B65B 5/02; B65B 5/04; B65B 47/00; B65B 61/26; B65D 75/36
See application file for complete search history.

(56) References Cited

U.S. PATENT DOCUMENTS 3,473,286 A * 10/1969 Henry ..... B44B 5/028 53/131.5
5,993,942 A 11/1999 Bakker
(Continued)

FOREIGN PATENT DOCUMENTS

EP 3045397 A1 7/2016
EP 3385174 A1 10/2018
(Continued)

OTHER PUBLICATIONS

Extended European Search Report for Application No. 20206458.0, dated May 6, 2021, 10 pages including machine translation.
(Continued)

*Primary Examiner* — Andrew M Tecco
*Assistant Examiner* — Nicholas E Igbokwe
(74) *Attorney, Agent, or Firm* — Morgan, Lewis & Bockius LLP

(57) ABSTRACT

Systems for producing a strip of pouches are provided. A guide device is configured to receive a packaging material web, the packaging material web comprising a plurality of cover sections extending in a longitudinal direction of the packaging material web and having a transmission of less than 60% in the visible frequency range, a transparent material area with a transmission of greater than 80% in the visible frequency range extending in the longitudinal direction parallel to the cover sections and a plurality of data sections. A printing device is configured to apply data to the data sections and an application device is configured to apply an information unit to the cover sections. Methods for producing a strip of pouches are also provided.

19 Claims, 5 Drawing Sheets

(51) Int. Cl.

| | |
|---|---|
| ***B65B 5/04*** | (2006.01) |
| ***B65B 47/00*** | (2006.01) |
| ***B65B 61/26*** | (2006.01) |
| ***B65D 65/40*** | (2006.01) |

(56) References Cited

U.S. PATENT DOCUMENTS

| | | | | |
|---|---|---|---|---|
| 10,427,810 | B2 | 10/2019 | Holmes | |
| 2007/0081715 | A1* | 4/2007 | Chaput | B65H 35/00 382/152 |
| 2011/0126495 | A1* | 6/2011 | Tampieri | B65B 5/103 53/467 |
| 2012/0145585 | A1* | 6/2012 | Doyle | B65D 75/327 206/534 |
| 2012/0145739 | A1* | 6/2012 | Doyle | B65D 75/327 225/56 |
| 2013/0061556 | A1* | 3/2013 | Hatsuno | B65B 61/26 53/52 |
| 2014/0318078 | A1 | 10/2014 | Kondo et al. | |
| 2016/0304228 | A1 | 10/2016 | Hellenbrand et al. | |
| 2017/0057682 | A1* | 3/2017 | Chudy | A61J 1/035 |
| 2018/0144455 | A1 | 5/2018 | Van Schelven | |
| 2018/0229877 | A1 | 8/2018 | Este | |
| 2018/0290775 | A1* | 10/2018 | Gross | B65B 9/207 |
| 2019/0000713 | A1 | 1/2019 | Kelly | |
| 2020/0324526 | A1 | 10/2020 | Berbert | |
| 2021/0161764 | A1 | 6/2021 | Devens | |
| 2021/0323743 | A1 | 10/2021 | Crider | |
| 2022/0194676 | A1 | 6/2022 | Kato | |

FOREIGN PATENT DOCUMENTS

| | | | |
|---|---|---|---|
| WO | WO-2013034504 | A1 | 3/2013 |
| WO | WO-2014119994 | A1 | 8/2014 |

OTHER PUBLICATIONS

European Office Action for Application No. 20206458.0, dated Dec. 13, 2024, 8 pages including translation.

* cited by examiner 43
400
4
401
41
400
401
40
41
401
400

43
400
4
401
41
400
401
40
41
403
402
400

43
400
4
41
400
40
41
400

4
400
41
41
400

METHOD AND DEVICE FOR PRODUCING A BLISTER TUBE, AND BLISTER TUBE

CROSS-REFERENCE TO RELATED APPLICATIONS

This application is a continuation of U.S. application Ser. No. 17/093,332, filed Nov. 9, 2020, issued as U.S. Pat. No. 12,043,464 on Jul. 23, 2024, entitled "METHOD AND DEVICE FOR PRODUCING A BLISTER TUBE, AND BLISTER TUBE," which is herein incorporated by reference in its entirety.

BACKGROUND

With modern automatic blister packing machines as disclosed, for example, in WO 2013/034504 A1, a large number of patient-specific drug compositions can be blister-packed per minute. The resulting blister tubes are usually guided out of the automatic blister packing machines and are then fed to a device for checking the contents of the individual blister pouches, i.e. it is determined whether those drug portions that should be present according to the medical specifications are also actually present in the blister pouches. Such checking is necessary because even with modern automatic blister packing machines occasional blister-packing errors can occur, so that there may be blister pouches in which too few or too many drug portions are blister-packed. In order to prevent administration to a patient of a drug that could be dangerous for them, checking of the blister tubes is necessary.

Manual checking, specifically by a user examining the individual blister pouches of a blister tube, can be carried out regularly with the assistance of an optical recording and playback system. Alternatively, the checking can be carried out automatically, with a user only having to intervene if, during the automated checking, such pouches are detected in which it cannot be clearly established that the correct drug portions are blister-packed. Since the involvement of a user is time-consuming and costly, efforts are made to keep the number of blister pouches that require final checking by a user as low as possible. Automatic checking is carried out with so-called inspection systems. An example of such a system is disclosed, for example, in WO 2014/119994 A1.

In order to be able to identify the blister pouches or their contents, respectively, these are always provided with pouch-specific data (for example, patient data), which can be used to infer the target content of the blister pouch and further data, for example information about the patient and when the drug should be taken. In order to have the least possible influence on the determination of the contents of the blister pouch during checking, the pouch-specific data are regularly applied to an outer area of the blister pouch. In addition, the printing of the data is kept to the smallest possible area in order not to negatively influence the checking, i.e. the printing as such is not perceived as a drug portion, resulting in generation of a false positive. It is therefore in any case to be avoided that the pouch-specific data applied are incorrectly interpreted by an automatic inspection system as a drug portion arranged in the blister pouch.

The way in which pouch-specific data are usually applied therefore makes it difficult or even impossible for some patient groups, for example those with visual impairments, to recognize the data. It is therefore desirable to provide a method and a device by which information can, for example, also be applied over a large area to a blister pouch without an inspection system being negatively influenced.

SUMMARY

One or more embodiments provide a system for producing a strip of pouches, comprising a guide device configured to receive a packaging material web, the packaging material web comprising a plurality of cover sections extending in a longitudinal direction of the packaging material web and having a transmission of less than 60% in the visible frequency range, a transparent material area with a transmission of greater than 80% in the visible frequency range extending in the longitudinal direction parallel to the cover sections; and a plurality of data sections, a printing device configured to apply data to the data sections; and an application device configured to apply an information unit to the cover sections.

One or more embodiments provide a method for producing a strip of pouches, the method comprising receiving, by a guide device, a packaging material web having a transparent material area with a transmission of greater than 80% in the visible frequency range extending in a longitudinal direction, printing, by a printing device, pouch-specific data onto a first data section of a plurality of data sections of the packaging material web, applying, by an application device, an information unit to a first cover section of a plurality of cover sections of the packaging material web, the plurality of cover sections extending in the longitudinal direction of the packaging material web and having a transmission of less than 60% in the visible frequency range, shaping, by a shaping device, a sub-section of the packaging material web into a receiving area, wherein at least a portion of a first cover section and the printed first data section are assigned to the receiving area and the pouch-specific data is arranged on an outside surface of the shaped sub-section; and forming a pouch from the receiving area.

The foregoing and other features, aspects and advantages of the disclosed technology will become more apparent from the following detailed description and accompanying drawings.

BRIEF DESCRIPTION OF THE DRAWINGS

One or more embodiments of the device according to the disclosure and the method for producing a blister tube comprising a plurality of blister pouches that can be provided with information over a large area and are optimized for an inspection system, as well as a corresponding blister tube are described below with reference to the drawings, in which.

DETAILED DESCRIPTION

Figure 1B:
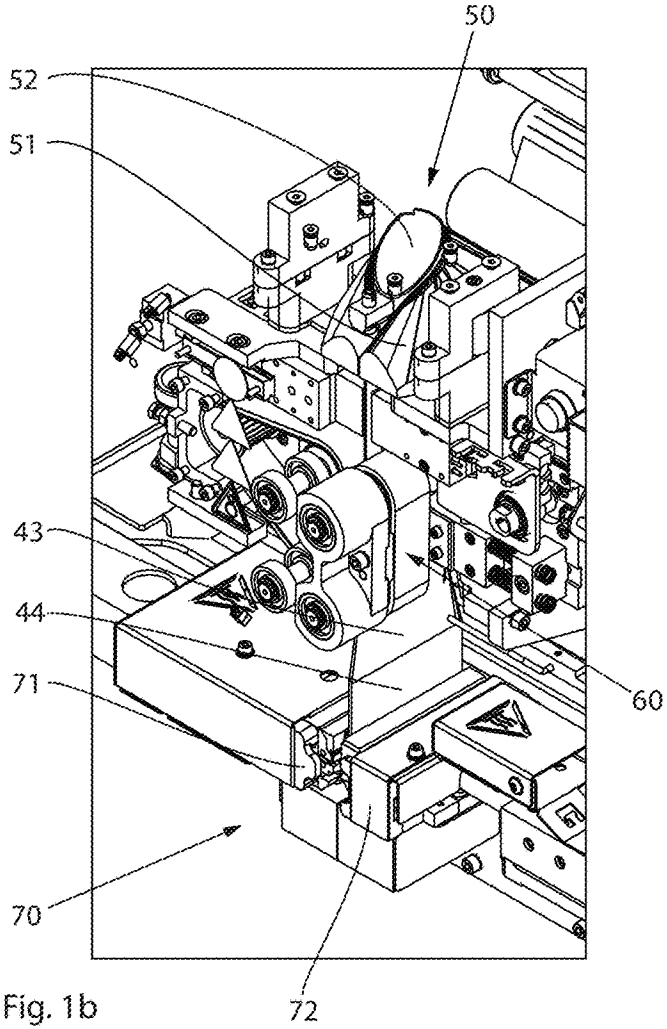
FIG. 1*b* is a perspective partial view of the packaging device of the packaging device of FIG. 1*a*, according to aspects of the disclosure.

The detailed description set forth below describes various configurations of the subject technology and is not intended to represent the only configurations in which the subject technology may be practiced. The detailed description includes specific details for the purpose of providing a thorough understanding of the subject technology. Accordingly, dimensions are provided in regard to certain aspects as non-limiting examples. However, it will be apparent to those skilled in the art that the subject technology may be practiced without these specific details. In some instances, well-known structures and components are shown in block diagram form in order to avoid obscuring the concepts of the subject technology.

It is to be understood that the present disclosure includes examples of the subject technology and does not limit the scope of the appended claims. Various aspects of the subject technology will now be disclosed according to particular but non-limiting examples. Various embodiments described in the present disclosure may be carried out in different ways and variations, and in accordance with a desired application or implementation.

The present disclosure relates to methods and devices for producing a blister tube, and to blister tubes. In particular, the disclosure relates to methods for producing a blister tube comprising a plurality of blister pouches which can be provided with information over a large area and are optimized for an inspection system, and also relates to a corresponding device and a blister tube as such.

The object is achieved according to the disclosure by a method for producing a blister tube comprising a plurality of blister pouches that can be provided with information over a large area and are optimized for an inspection system. According to the disclosure, a packaging material web with a plurality of cover sections extending in the longitudinal direction of the packaging material web with a transmission of less than 60% in the visible frequency range, a transparent material area extending in the longitudinal direction parallel to the cover sections with a transmission of greater than 80% in the visible frequency range and a plurality of data sections are provided, pouch-specific data are printed on a data section, a sub-section of the packaging material web is formed into a receiving area, wherein at least one cover section or at least one sub-area thereof and the previously printed data section are assigned to each receiving area, small piece goods are fed to the receiving area and finally a blister pouch is formed from the receiving section including small piece goods.

By providing a plurality of cover sections with a transmission of less than 60% in the visible frequency range in the packaging material web, it is possible to provide these cover sections over a large area with data which, for example, indicate when the drug portions contained in a blister pouch should be taken. Moreover, alternatively or additionally further data can be applied, so that it is also conceivable to apply advertising data, specifically in a large number of colors, without hindering the detection of the drug portions in the inspection system. By providing a packaging material web with cover sections with a transmission of less than 60% in the visible frequency range, the data applied over a large area, possibly applied to the cover sections, cannot interfere with the inspection since, due to the low transmission for visible light of the cover sections, these data applied over a large area cannot be perceived as supposed drug portions if the inspection system works according to certain specifications, that is to say the inspection of a blister pouch is carried out only by visible light irradiated from one side (opposite the cover sections).

The transmission can be reduced both by absorption within the cover sections and also by reflection of the light. For this purpose, a cover section can have on the underside a type of mirror layer which reflects the light shining through a cover section.

The cover sections can be designed in such a way that they complement one another to form a continuous strip, i.e. (viewed in the longitudinal direction) half of the packaging material web can be formed, for example, by cover sections and half can be formed by a transparent material area. Alternatively, the cover sections can only form repeating partial areas of one half of the packaging material web—the rest of this half then usually forms a carrier material or transparent material. The exact design of the cover sections depends crucially on the type of production thereof—if, for example, they are first "produced" in an automatic blister packing machine, they are usually applied to half of a packaging material web made of a uniform carrier layer material which usually also has a transmission greater than 80% in the visible frequency range. Alternatively, it is conceivable to use a packaging material web with already predetermined cover sections. The cover sections can then form, for example, one half of the packaging material web.

On the material area the data sections can be provided with a transmission of greater than 80% in the visible frequency range, in particular if they are arranged in an area that does not interfere with the subsequent inspection. However, the method is preferably carried out in such a way that the data sections are provided on the cover sections, so that the applied data cannot interfere with the inspection due to the low transmission of the cover sections, regardless of the positioning of the data sections.

The pouch-specific data can be patient data, for example, or the pouch-specific data can include patient data. However, it is also conceivable that the pouch-specific data have no relation to a specific person, but only relate to the contents and/or the time when the drug should be taken.

A large-area information unit, which does not interfere with a contents check of the blister pouches in an inspection system when the method is carried out accordingly, can be applied to the cover sections. The information unit can already be applied after the production of the packaging material web and the creation of the cover sections. For example, one information unit can be applied every x centimeters. Alternatively, every xth cover section (possibly equivalent to every xth pouch) can be provided with a special information unit (for example, when the drug should be taken: morning, midday, evening). The information unit can be printed on, for example. Alternatively, it is also conceivable to design the information unit as a sticker that is applied to a cover section.

However, the application of the information unit directly after the production of the packaging material web leads to the fact that the packaging material web cannot be used flexibly without changing the positioning of the possibly large-area information unit in the resulting blister pouches. For example, it is not possible to produce blister pouches of different lengths without moving the position of the information unit on the blister pouches. Therefore, in one or more embodiments of the method according to the disclosure, it is provided that before the formation of the receiving area a cover section is provided with an information unit in such a way that the information unit is arranged on the outside of the blister pouch to be formed, and thus does not interfere with the checking of the blister pouch contents in the inspection system if the inspection is carried out from the side opposite the printing from the transparent material area of the original packaging material web. This way of carrying out the method has the advantage that the application of the information unit can be adapted to the length of the blister pouch to be produced, which in turn can be adapted to the amount and/or size of the drug portions to be introduced.

When the method is carried out accordingly, it is advantageously further provided that, before the application of an information unit to a cover section, pouch-specific data are retrieved or received and the application of the information unit to a cover section is carried out on the basis of the data. When the method is carried out accordingly, information units that are clearly recognizable for people with visual impairments can be applied, for example, and provide information about the time when the drug portions arranged in a blister pouch should be taken. If corresponding information units are already applied during the production of the packaging material web, empty pouches may have to be produced if for one user blister pouches are only produced for the drug to be taken in the morning and the evening, but for another user blister pouches are produced for the drug to be taken three times per day.

As already indicated above, the cover sections can be provided during the production of the packaging material web. This means that the cover sections are identical for the entire packaging material web. One or more embodiments of the method according to the disclosure is characterized in that the packaging material web is provided with a plurality of cover sections extending in the longitudinal direction of the packaging material web by applying a layer with reduced transparency (with a transmission less than 60% in the visible frequency range) to a carrier layer material area of the packaging material web. In one or more embodiments, the cover section can therefore only be produced shortly before the application of the possibly large-area information unit, and can be adapted to the manner of application. It is also conceivable that the cover sections are designed in accordance with the pouch-specific data, for example a special color is selected for a special time when the drug should be taken.

In order to make the device for producing the blister tube as simple as possible, in one or more embodiments it is provided that the layer with reduced transparency is produced by printing a colored layer or applying a cover layer to the carrier layer material area, wherein from the point of view of the simplicity of the device it is particularly preferable that the layer with reduced transmission is printed on.

In order to prevent an information unit applied to the cover sections from being rubbed off or otherwise removed, for example during the transport of the blister tube, in one or more embodiments of the method it is provided that at least the cover sections are covered with a protective layer after the application of an information unit.

The object is also achieved by a device for producing a blister tube comprising a plurality of blister pouches which can be provided with information over a large area and which are optimized for an inspection system. The device according to the disclosure comprises a printing device coupled to a control device for applying pouch-specific data to a data section of a packaging material web, an application device coupled to a control device for applying an information unit to a cover section of a packaging material web, a packaging material guide device arranged upstream of the printing and application devices for receiving a packaging material web with a plurality of cover sections extending in the longitudinal direction of the packaging material web with a transmission of less than 60% in the visible frequency range, a transparent material area with a transmission of greater than 80% in the visible frequency range extending in the longitudinal direction parallel to the cover sections and a plurality of data sections, wherein the packaging material web guide device is designed in such a way that the data sections are assigned or fed to the printing device, respectively, and the cover sections are assigned or fed to the application device, respectively, a packaging material shaping device for receiving the packaging material web, wherein the packaging material shaping device is designed such that the packaging material web is shaped into a receiving area in such a way that it is suitable for receiving small piece goods and is continued in a running direction, and a joining device for joining the packaging material web shaped into a receiving area to form a blister pouch of a blister tube.

By the provision of a printing device and an application device it is possible to apply pouch-specific data to data sections and to apply a (large-area) information unit to the cover sections, wherein the information unit can show, for example, the time when the drug portions arranged in a blister pouch should be taken. In the case of corresponding devices according to the prior art, only a printing device is provided by which pouch-specific data can be applied, but no additional information unit is provided. With the device according to the disclosure it is possible to produce blister tubes having blister pouches which are provided over a large area with information units and are suitable for an inspection system despite the information units, since the packaging material web is guided in such a way that the information units are applied to the non-transparent cover sections.

In one or more embodiments of the device it is provided that it comprises a cover section device arranged upstream of the application device for applying the plurality of cover sections. With a corresponding device, it is also possible to use "normal" packaging material in which no cover sections are provided that are not transparent to visible light. Thus, with an appropriate device, a normal packaging material web can also be used to produce blister pouches.

The object is also achieved by a blister tube with a plurality of blister pouches which can be provided with information over a large area and are optimized for an inspection system. In the case of the blister tube according to the disclosure, each blister pouch has a receiving area for small piece goods, in which the drug portions of a composition are arranged after the formation of the blister pouch. Each blister pouch comprises at least one data section and a cover section as well as a transparent material area with a transmission of greater than 80% in the visible frequency range arranged opposite a cover section, wherein the cover section covers the receiving section in such a way that all small piece goods arranged in the receiving space can be covered. According to the disclosure, the blister tube is characterized in that the cover section has a transmission of less than 60% in the visible frequency range. As already explained above, a corresponding blister tube can be used in an inspection system despite the application of the information unit over a large area, without simulating drug portions that are not present in the inspection system.

In one or more embodiments of the blister tube it is provided that although the cover sections are not transparent to visible light they are permeable to light in the near infrared range.

In order to prevent the patient-specific data from interfering with the detection, in one or more embodiments of the blister tube it is provided that the data section and the cover section of a blister pouch are arranged on the same side.

Figure 1A:
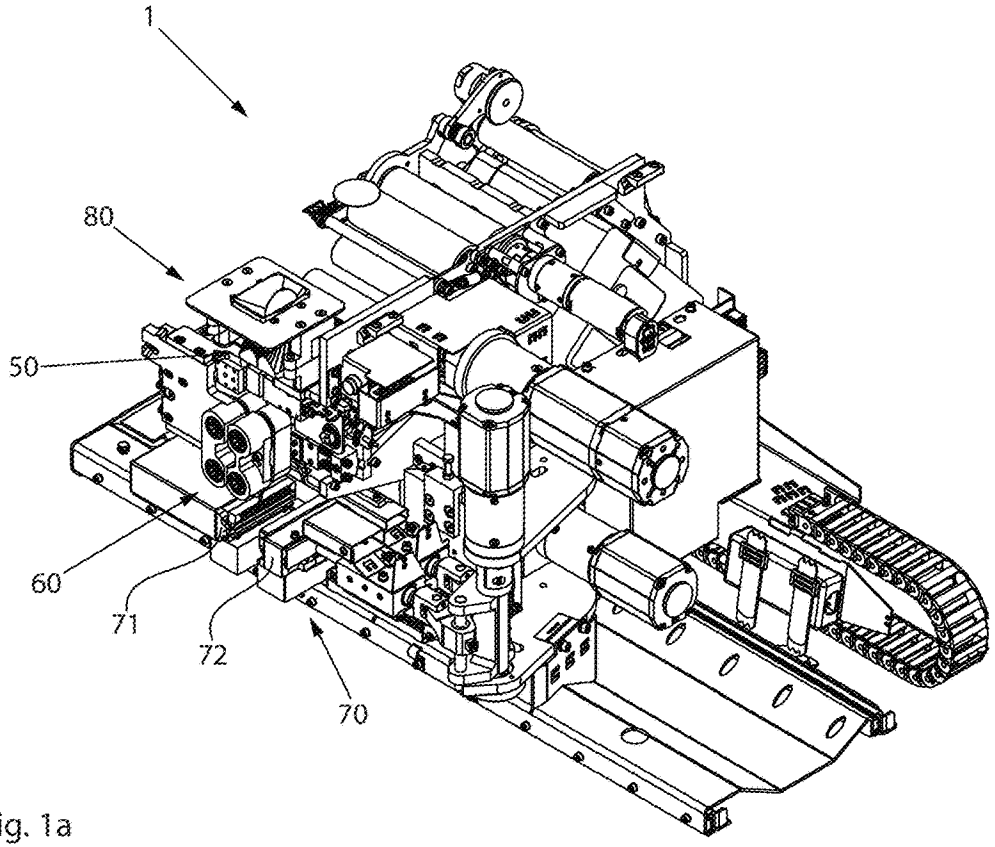
FIG. 1*a* is a perspective view of one or more embodiments of a packaging device with a packaging material web omitted, according to aspects of the disclosure.
Figure 2A:
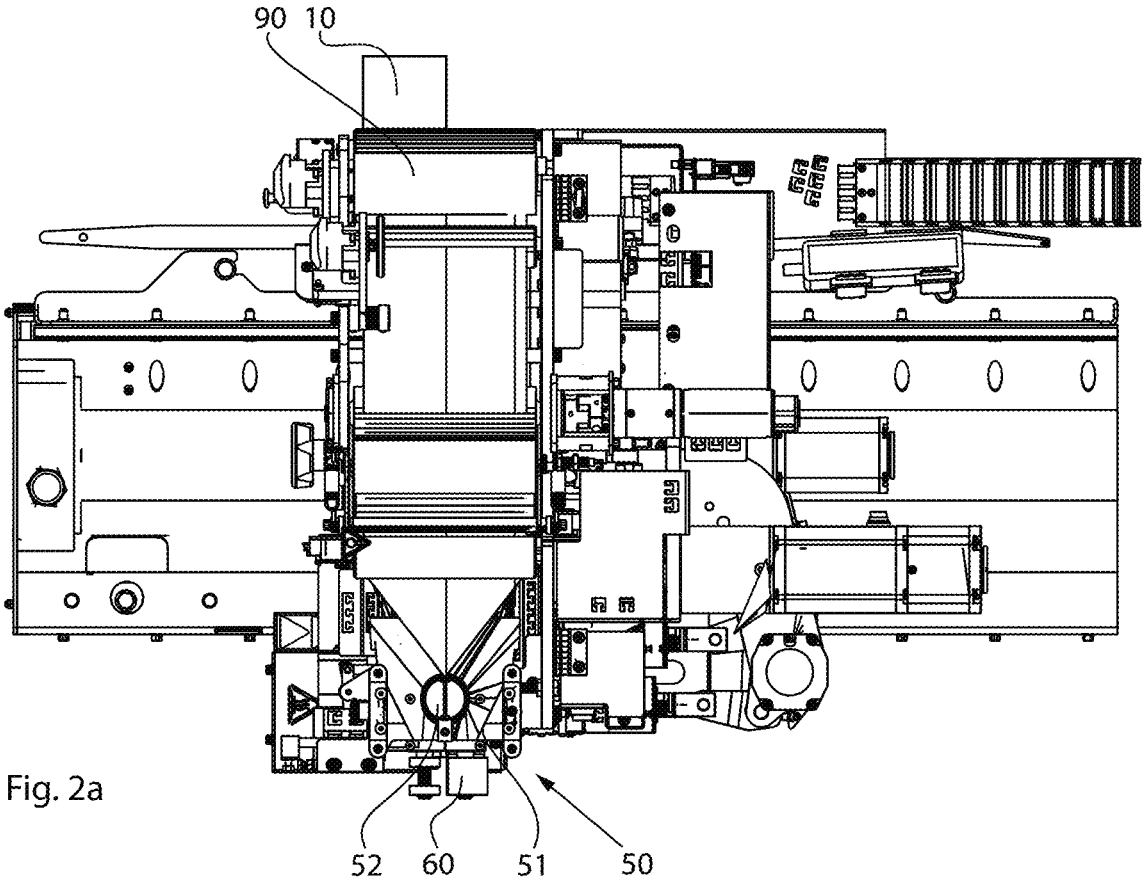
FIG. 2*a* is a top view of the packaging device of the packaging device of FIG. 1*a*, according to aspects of the disclosure.

FIGS. 1*a* and 1*b* show oblique views of one or more embodiments of the device 1 according to the disclosure, wherein a packaging material web 40 is omitted in FIG. 1*a* in order not to cover other components of the device 1. The device 1 shown in FIGS. 1*a* and 1*b* largely corresponds to the device disclosed in EP 3 385 174 A1, the disclosure content of which is hereby incorporated into this application. The device 1 according to the disclosure shown in FIGS. 1*a* and 1*b* comprises a packaging material shaping device 50, which shapes an elongated packaging material web 40 (see FIGS. 2*a* and 2*b*) into a receiving area 43 indicated in FIG. 1*b* for drug portions and continues the same in a running direction of the packaging material web 40.

The device further comprises a joining device 60, 70 for joining the shaped packaging material web to form a blister pouch 3 of a blister tube 2 (see FIG. 3), wherein this joining device 60, 70 comprises a longitudinal joining device 60 and a transverse joining device 70, which are designed as separate components. Depending on the precise guiding of the packaging material web 40 and the joining thereof to form a blister pouch 3, the joining device 60, 70 can also be constructed differently, in this connection see for example EP 3 045 397 A1.

In one or more embodiments, the packaging material shaping device 50 cooperates with a drug portion feed 80 which is arranged above the packaging material shaping device 50. This comprises a type of funnel, by which drug portions are fed to the receiving area 43 through an opening 52 in the packaging material shaping device 50 (see in particular FIG. 1*b*). For shaping of the packaging material web 40 fed to the packaging material shaping device 50, the packaging material shaping device 50 has a shoulder-like surface 51 which shapes the packaging material web 40 in such a way that the receiving area 43 is formed. As can be seen in FIG. 1*b*, a transverse joining area 44 is indicated below the receiving area 43, in which the packaging material web 40 is joined by joining assemblies 71, 72 of the transverse joining device 70. Depending on the material of the packaging material web 40, this can be achieved, for example, by heating at least one of the joining assemblies 71, 72. The joining assemblies 72 can be moved horizontally and is opened after the joining of the transverse joining area 44, so that the packaging material web 40 can be guided further in the running direction. However, the exact way in which the blister pouch 3 is formed from the packaging material web 40 is not essential to the present disclosure, and for a more detailed description reference is made to the aforementioned European patent application EP 3 385 174 A1.

Figure 2B:
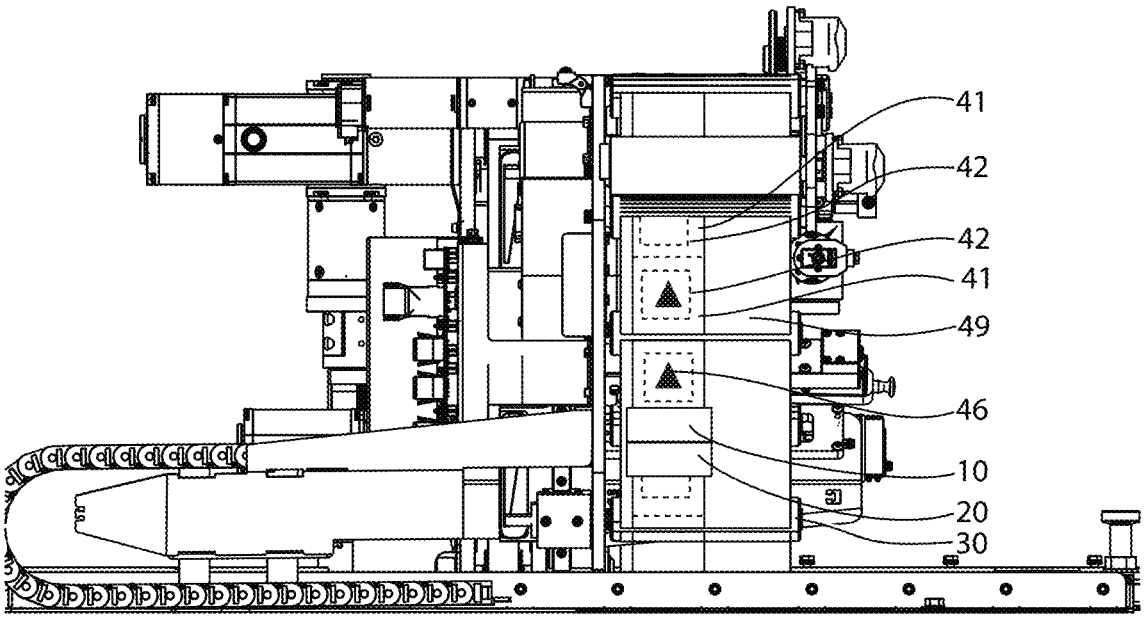
FIG. 2*b* is a rear view of the packaging device of the packaging device of FIG. 1*a*, according to aspects of the disclosure.

As can be seen in FIG. 2*b*, the device 1 according to the disclosure comprises a first printing device 10 and an application device 20 which, in one or more embodiments, is also designed as a (second) printing device 20, wherein the printing devices 10, 20 are arranged one behind the other. As can be seen in the rear view according to FIG. 2*b*, the two printing devices 10, 20 are arranged "at the rear" in the device 1, specifically behind one another in such a way that both printing devices 10, 20 are assigned to half of the elongated packaging material web 40, specifically that with the cover sections 41. As indicated in FIG. 2*b*, upstream of the printing devices 10, 20 there are a packaging material guide device 30 for receiving a packaging material web 40 with a plurality of cover sections 41 with a transmission less than 60% in the visible frequency range extending in the longitudinal direction of the packaging material web 40 and a transparent material area 49 with a transmission of greater than 80% in the visible frequency range extending in the longitudinal direction parallel to the cover sections 41. A plurality of data sections 42 which extend in the longitudinal direction at a distance from the transparent area 49 are arranged on the cover sections 41. In one or more embodiments, the cover sections 41 and the data sections 42 are arranged in such a way that the cover sections 41 and data sections 42 are located on the "same side" of the packaging material web 40 and the transparent material area 49 is completely free of information of any kind, so that there is the least possible interference with the inspection. In some aspects of the disclosure, the data section 42 may be provided on the side with the transparent material area 49, as is illustrated below. This is conceivable in particular if the data are only arranged on a very small scale in the outer area of a subsequent pouch 3.

Figure 3:
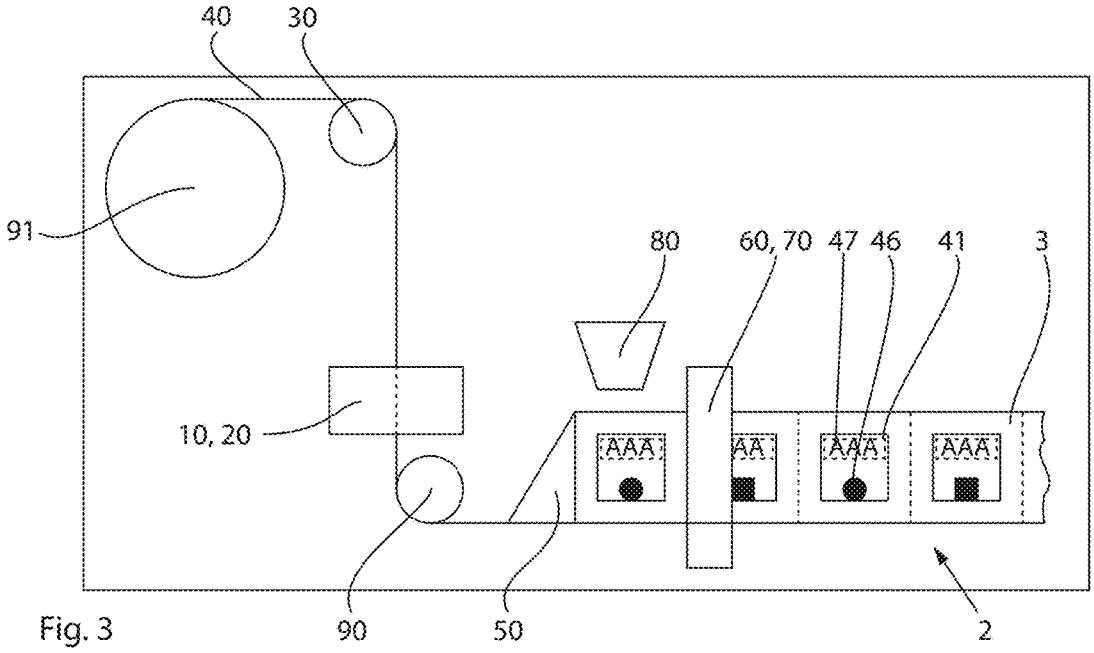
FIG. 3 shows a schematic view of one or more embodiments of a packaging device with a packaging material web omitted, according to aspects of the disclosure.

In one or more embodiments, due to the arrangement of a supply roller 90 (not visible in FIGS. 2*a*, 2*b*) for the packaging material web 40, the guide device 50 is only designed as a deflection roller 91 (see FIG. 3). If a different running path for the packaging material web 40 or a differently provided packaging material web 40 is used in the device 1, it may be necessary to use a more complex packaging material guide device 50, i.e. depending on the arrangement of the printing devices 10, 20 and the way in which the packaging material web 40 is stored, the guide device 50 must be adapted accordingly. For example, it is conceivable that the packaging material web 40 is stored already folded on the longitudinal axis, so that the packaging material web guide device 50 is then to be designed in such a way that the cover and data sections 41, 42 which then lie opposite are fed to correspondingly arranged printing devices.

As can be seen in FIG. 2*b*, a packaging material web 40 is provided which has a plurality of cover sections 41 extending in the longitudinal direction and a plurality of data sections 42. As shown in FIG. 2*b*, the cover sections 41 are arranged in such a way that they enclose the complete "left" half of the packaging material web 40 and form a continuous cover layer on which the data sections 42 are provided. The "right" side is formed by a transparent material area 49. In some aspects of the disclosure, it is conceivable that the cover sections 41 are designed, for example, as repeating sub-areas of the left section of the packaging material web 40. Sections made of carrier material or transparent material, respectively, can then extend between the cover sections 41. The data sections 42 are those areas of the packaging material web 40 which are provided for later printing with patient information. These can be specially marked, but it may also be the case that they only define a predetermined area in a section of the packaging material web 40, that is to say they do not comprise any physical manifestation on the packaging material web 40.

Figure 4A:
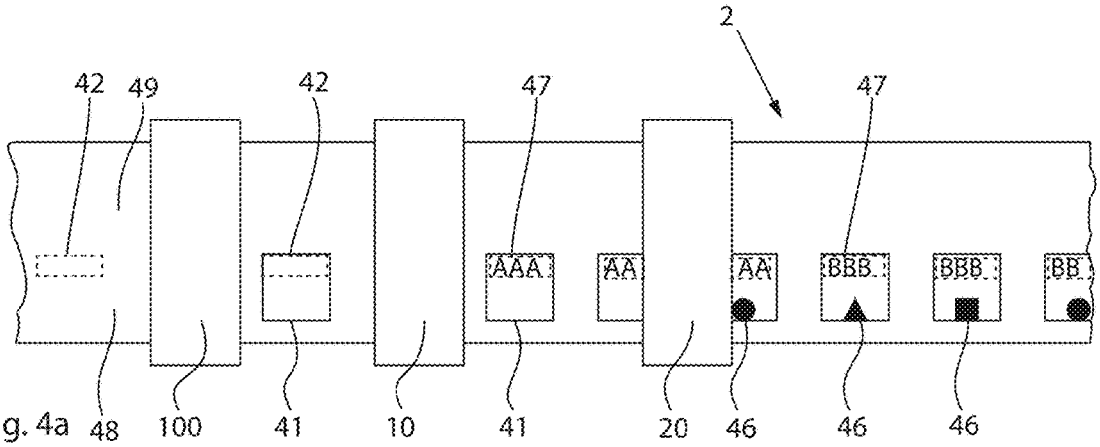
FIG. 4*a* illustrates a portion of a method of forming blister pouches, according to aspects of the disclosure.
Figure 4B:
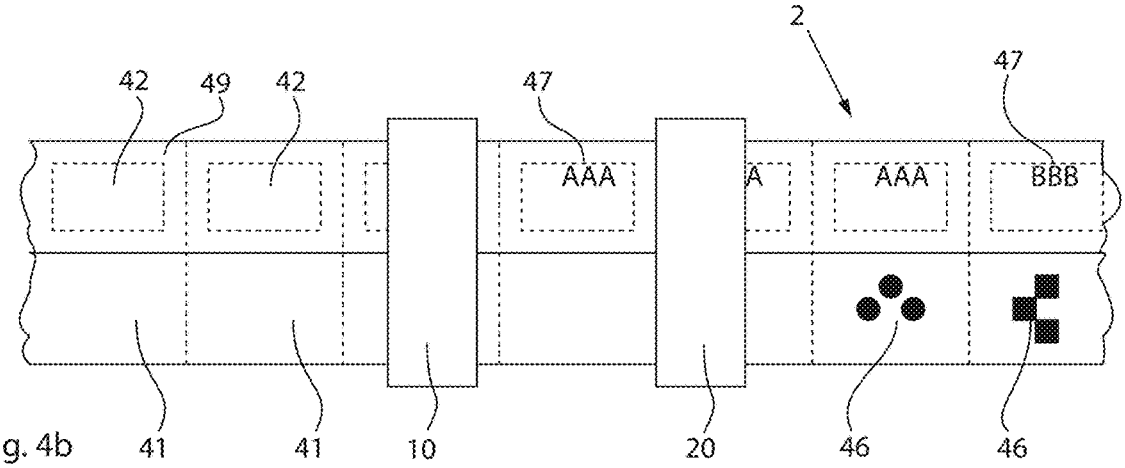
FIG. 4*b* illustrates a portion of another method of forming blister pouches, according to aspects of the disclosure.

FIG. 3 shows a greatly simplified, schematic representation of one or more embodiments of the device 1 according to the disclosure, FIGS. 4*a* and 4*b* show sub-areas of one or more embodiments, wherein in FIG. 4*b* a first and second printing device 10, 20 are shown one behind the other and in FIG. 4*a* a cover section device 100 which is designed as a third printing device is additionally illustrated. Various embodiments of methods according to the disclosure are to be described with reference to FIGS. 3, 4*a* and 4*b*.

Firstly, a packaging material web 40 is provided by a packaging material web roller 90, in the present case without pre-shaping of the packaging material web 40, i.e. the packaging material web 40 is provided on the packaging material web roller 90 without any folding. In some aspects of the disclosure, it is conceivable that the packaging material web 40 is arranged on the packaging material web roller 90, for example, already pre-folded on the longitudinal axis.

In one or more embodiments shown in FIGS. 3 and 4*b*, the provided packaging material web 40 comprises a plurality of cover sections 41 extending in the longitudinal direction of the packaging material web 40 and a plurality of data sections 42 which, in the embodiment according to FIG. 4*b*, extend in the longitudinal direction distanced from the cover sections 41. In the embodiment shown in FIG. 4*a*, the packaging material web 40 does not yet comprise any cover sections 41, but these are only applied by a cover section device 100 designed as a third printing device. In some aspects of the disclosure, the cover sections 41 can also be applied as non-transparent film sections or (possibly already printed) stickers.

In the embodiment shown in FIG. 4*b*, the cover sections 41 can be seen in the lower half of the packaging material web 40, wherein these cover sections 41 form a continuous cover section area without interruption. The dashed vertical lines indicated in FIG. 4*b* are only intended to indicate the area in which the shaped packaging material web 40 will later be joined. The "upper" half of the packaging material web 40 is formed by a transparent material area 49 with a transmission of greater than 80% in the visible frequency range.

The packaging material web 40 is fed from the packaging material web roller 90 via a packaging material web guide device 30 to a first printing device 10, wherein pouch-specific data 47 are applied to a data section 42 in the printing device 10, as indicated in FIGS. 4*a* and 4*b*. In the embodiments described in FIGS. 4*a* and 4*b*, the two printing devices 10, 20 are not arranged adjacent to one another, but one behind the other. An application device 20 designed as a second printing device 20 is arranged downstream of the first printing device 10 and, in the embodiment shown according to FIGS. 4*a* and 4*b*, before shaping of a blister pouch 3 an information unit 46 in the form of an imprint is applied to a cover section 41, specifically in such a way that the imprint is arranged on the outside of the blister pouch 3 that is to be formed subsequently.

As shown, it is the case that after the application of the pouch-specific data 47 and the imprints the blister pouch 3 is folded on the center line of the packaging material web 40, so that both imprints are automatically arranged on the outside. After the pouch-specific data and the imprints are applied by the first and second printing devices 10, 20, the packaging material web 40 is fed via a deflection roller 91 to a packaging material web shaping device 50, which shapes the packaging material web 40 into a receiving area 43 in such a way that it is suitable for receiving small piece goods. Drug portions are fed via a drug portion feed 80 to the receiving area 43. During or after the feeding, a blister pouch 3 of a blister tube 2 is formed from a receiving area 43 by a joining device 60, 70 by joining the packaging material web 40 by the joining device 60, 70, for example by the action of heat. For this purpose, the joining device 60, 70 can comprise a transverse joining device 70 and a longitudinal joining device 60, as indicated in FIGS. 1*a*-2*b*. As already described with reference to the preceding figures, the precise design of the joining device 60, 70 is not essential to the present disclosure. The guiding of the packaging material web 40 after shaping is also not essential. For example, FIG. 3 shows schematically that the packaging material web 40 is guided horizontally, whereas vertical guiding was provided in the previous figures. The precise guiding of the packaging material web 40 and the joining thereof to form a blister pouch 3 depends on the exact design of the device 1 with regard to these components, but is not essential to the disclosure.

FIG. 4*b* shows the printing area of a further embodiment of the device 1 according to the disclosure and of the method according to the disclosure. Here, a cover section device 100 designed as a third printing device 100 is provided, by which the cover sections 41 are applied to the packaging material web 40. In contrast to the embodiment described above, the packaging material web 40 with the plurality of cover sections 41 is provided by actively applying the cover sections 41, and a packaging material web 40 already having these cover sections 41 is not used. Although this increases the structural complexity of the device 1, it is possible thereby, for example, to generate cover sections 41 of different sizes, shapes or colors, for example by supplying the third printing device 100 with patient-specific printing information. In this embodiment the section of the packaging material web 40 to which the cover sections 41 are applied is formed by a carrier layer material area 48. The "upper" section of the packaging material web 40 is in turn formed by a transparent material area 49 with a transmission of greater than 80% in the visible frequency range. In such an embodiment, the two transparent material areas 48, 49 will be produced regularly in one piece from the same material, i.e. a material with a transmission of greater than 80% in the visible frequency range.

In contrast to the embodiment according to FIG. 4*b*, the data sections 42 are also arranged in the lower section, which can be seen in particular in the area of the third printing device 100.

The cover sections 41 are applied by the third printing device 100, the pouch-specific data are applied by the first printing device 10 arranged downstream, and the information units 46, in this case simple imprints, are applied to the cover sections 41 by the second printing device 20 arranged downstream of the first printing device 10.

Figure 5:
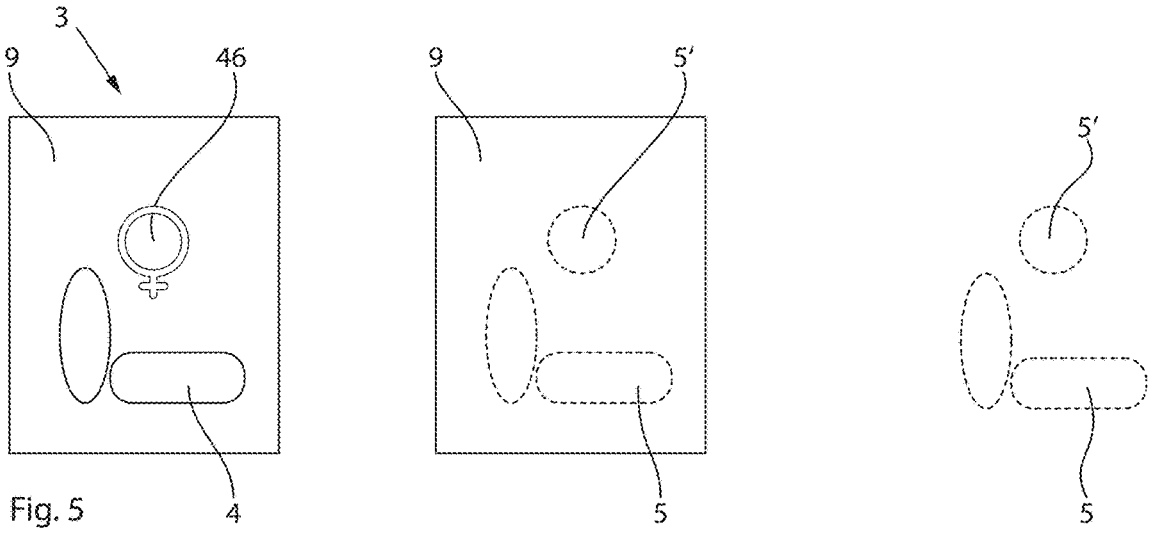
FIG. 5 illustrates a method of an inspection of a known blister pouch printed over a large area, according to aspects of the disclosure.

FIG. 5 schematically illustrates an inspection of a blister pouch 3 with two drug portions 4 and an imprint 46 on a transparent material 9 of a blister pouch. In the middle image it can be seen that the imprint 46 shown in the left image is detected as an outline 5' of a drug portion if a "conventional" blister pouch 3 is used which consists only of transparent material 9, and the inspection of the pouch contents is carried out using visible light. As a result, in the case of a blister pouch 3 with only two drug portions 4 and an imprint 46, two drug outlines 5' and an outline 5' of the imprint are determined, so that three drug portions 4 are detected during the inspection, although only two drug portions 4 are contained in the blister pouch 3.

Figure 6:
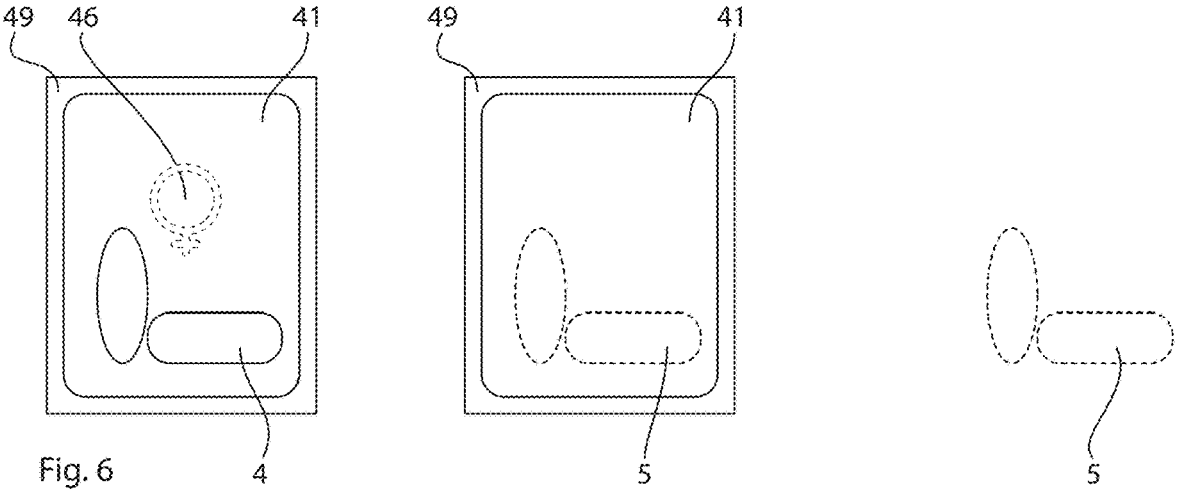
FIG. 6 illustrates a method of an inspection of a blister pouch of a blister tube, according to aspects of the disclosure.

The result of an inspection of a blister pouch 3 with a cover section 41 is illustrated in FIG. 6. The imprint 46 is only shown by dashed lines in the illustration on the left in FIG. 6, since it cannot actually be seen in the top view shown. If the inspection of the pouch 3 with visible light is carried out from "above" through the transparent material area 49 of the original packaging material web, the imprint 46 is not detected due to the reduced transparency of the cover section 41, so that as a result (right illustration) it is correctly recognized that two drug portions 4 are arranged in the blister pouch 3.

Figure 7A:
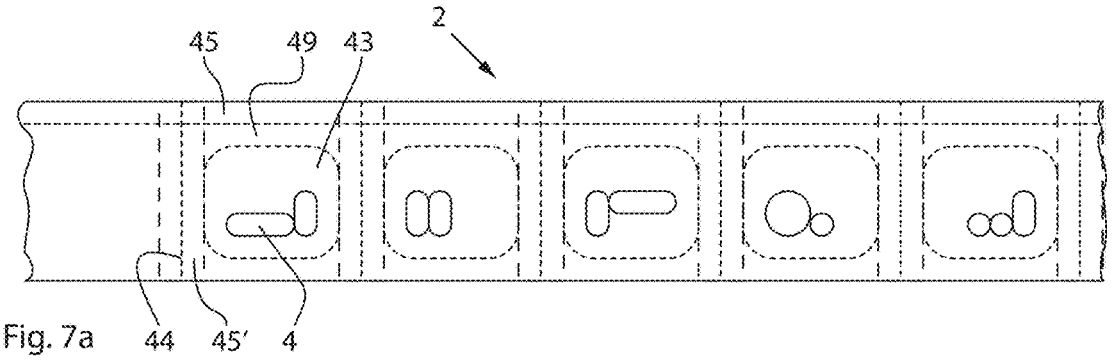
FIGS. 7*a* and 7*b* are side views of a blister tube, according to aspects of the disclosure.
Figure 7B:
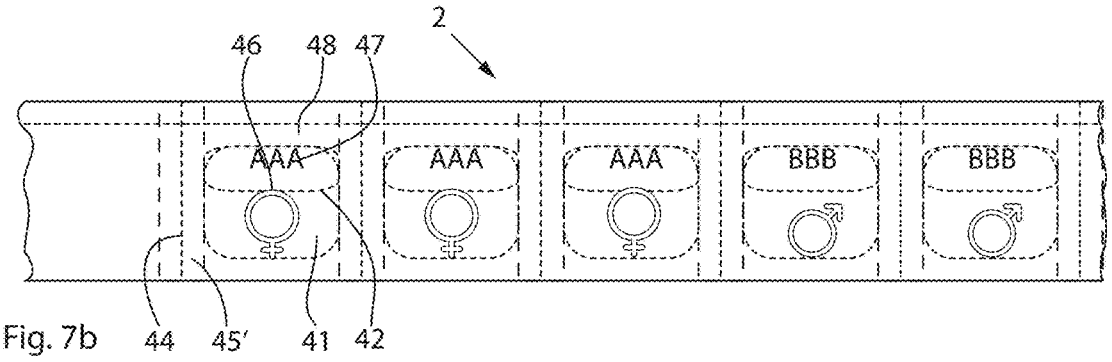

FIGS. 7*a* and 7*b* show two views of a blister tube 2 according to the disclosure with a plurality of blister pouches 3 that are printed over a large area and are optimized for an inspection system. In FIG. 7*a*, perforations 44 can be seen in transverse joining areas 45' which separate the individual blister pouches from one another. Each blister pouch 3 comprises a receiving area 43 in which a plurality of drug portions 4 are arranged. Furthermore, each blister pouch 3 comprises a data section 42 and a cover section 41, in which pouch-specific data 47 and an imprint 46 are applied. A longitudinal joining area 45 can also be seen in the upper area of the blister tube 2.

In FIG. 7*b* it can be seen that the imprint 46 is arranged on a cover section 41 and the data 47 are arranged in a data section 42 on the "same side" of the blister tube 2 or a blister pouch 3, respectively. Since the cover sections 41 are less transparent to visible light, the imprints 46 and the data 47 cannot be seen in the side view according to FIG. 7*a*.

FIGS. 8*a*-8*d* each show on the left side a cross section through a packaging material web 40 and on the right side a section of a blister pouch 3 formed from the packaging material web 40, wherein the longitudinal joining area 45 on the right and the fold-down area on the left are omitted. In the embodiment of the packaging material web 40 shown in FIG. 8*a*, this comprises a lower inner layer 400 made of, for example, LDPE, a superimposed carrier layer 401 made of PET and in the "left" area a cover layer which defines the cover section 41. The packaging material web 40 shown on the left is shaped by a packaging material web forming device 50 in such a way that the packaging material web 40 is folded in the middle area and a blister pouch 3 is thus created, as is shown in sections on the right. Due to the folding according to the arrow shown, the cover layer 402 is arranged on the inside during folding as such, so that the cover section 41 is arranged "inside." The receiving area 43 is arranged between the folded areas of the packaging material web 40, and a drug portion 4 is arranged therein. In the case of an inspection of the blister pouch 3 "from below" and printing "on" the cover section 41 from above, the printing cannot be perceived as a supposed drug portion 4 during the inspection due to the non-transparent cover section 41.

Figures 8A, 8B, 8C, 8D:
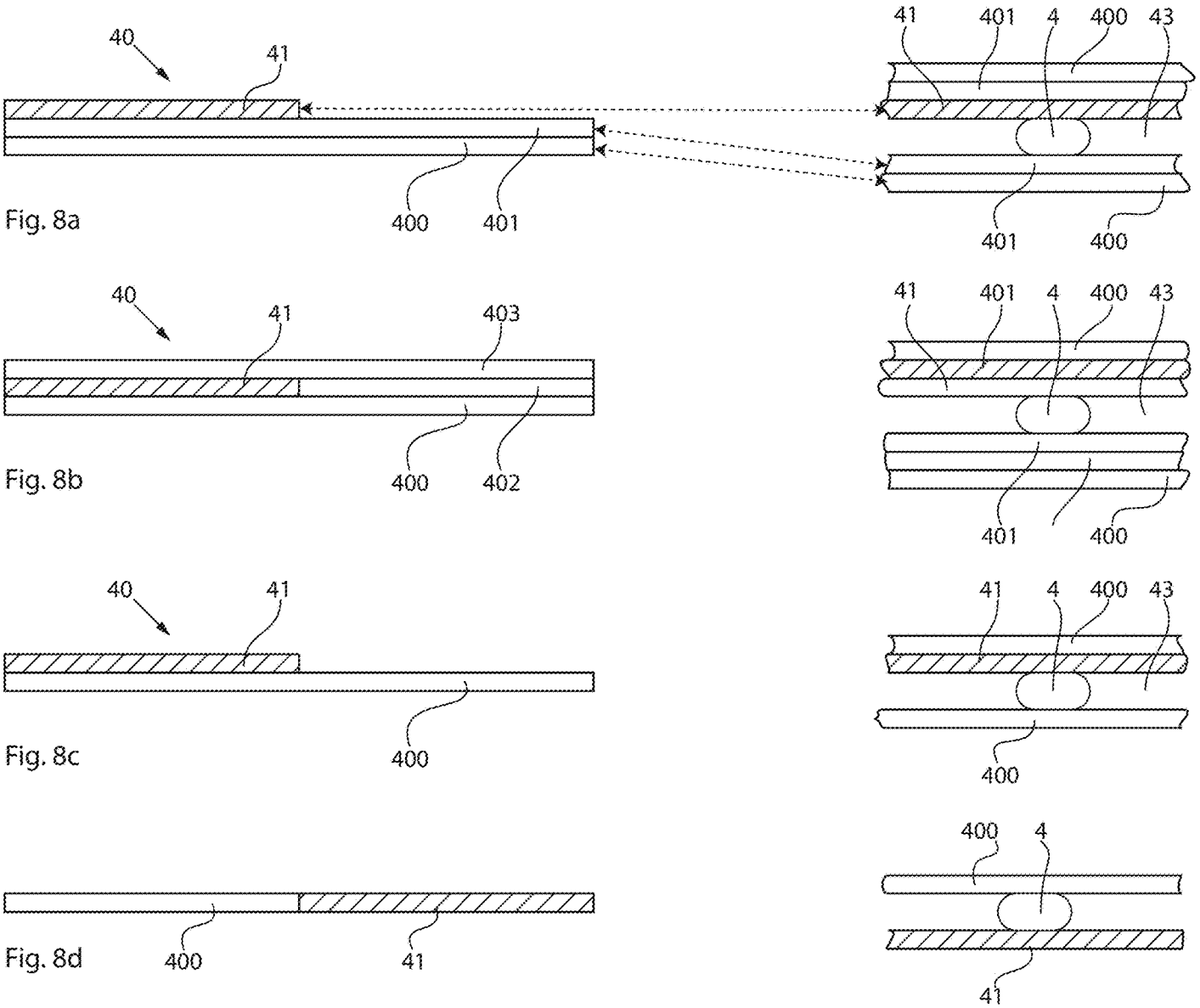
FIG. 8*a*-8*d* are front views of one or more embodiments of a packaging material web structure, according to aspects of the disclosure.

In FIGS. 8*b* to 8*d* further embodiments of a packaging material web 40 that can be used according to the disclosure are shown, wherein in FIG. 8*b* the cover layer 402 is covered by a protective layer 403, in FIG. 8*c* the cover layer 402 is applied directly to the inner layer 400 and in FIG. 8*d* the cover layer 402 is molded directly onto the inner layer 400, so that the blister pouch 3 "above" and "below" in each case has only a single layer.

Whether the cover sections 41 are already provided with the packaging material web 40 or are applied in the course of the method according to the disclosure is dependent on the precise procedure used. The exact application or design of the cover sections 41 is also dependent on the procedure, and it is only essential that a cover section 41 covers the receiving area 43 of a blister pouch 3, so that a possible imprint 46 on or over the cover section 41 during an inspection of a blister pouch 3 is not perceived as a drug portion 4 or can be misinterpreted, respectively.

The present disclosure is provided to enable any person skilled in the art to practice the various aspects described herein. The disclosure provides various examples of the subject technology, and the subject technology is not limited to these examples. Various modifications to these aspects will be readily apparent to those skilled in the art, and the generic principles defined herein may be applied to other aspects.

A reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

The word "exemplary" or the term "for example" is used herein to mean "serving as an example or illustration." Any aspect or design described herein as "exemplary" or "for example" is not necessarily to be construed as preferred or advantageous over other aspects or designs. In one aspect, various alternative configurations and operations described herein may be considered to be at least equivalent.

As used herein, the phrase "at least one of" preceding a series of items, with the term "or" to separate any of the items, modifies the list as a whole, rather than each item of the list. The phrase "at least one of" does not require selection of at least one item; rather, the phrase allows a meaning that includes at least one of any one of the items, and/or at least one of any combination of the items, and/or at least one of each of the items. By way of example, the phrase "at least one of A, B, or C" may refer to: only A, only B, or only C; or any combination of A, B, and C.

A phrase such as an "aspect" does not imply that such aspect is essential to the subject technology or that such aspect applies to all configurations of the subject technology. A disclosure relating to an aspect may apply to all configurations, or one or more configurations. An aspect may provide one or more examples. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples. A phrase such an embodiment may refer to one or more embodiments and vice versa. A phrase such as a "configuration" does not imply that such configuration is essential to the subject technology or that such configuration applies to all configurations of the subject technology. A disclosure relating to a configuration may apply to all configurations, or one or more configurations. A configuration may provide one or more examples. A phrase such a configuration may refer to one or more configurations and vice versa.

In one aspect, unless otherwise stated, all measurements, values, ratings, positions, magnitudes, sizes, and other specifications that are set forth in this specification, including in the claims that follow, are approximate, not exact. In one aspect, they are intended to have a reasonable range that is consistent with the functions to which they relate and with what is customary in the art to which they pertain.

It is understood that the specific order or hierarchy of steps, operations or processes disclosed is an illustration of exemplary approaches. Based upon design preferences, it is understood that the specific order or hierarchy of steps, operations or processes may be rearranged. Some of the steps, operations or processes may be performed simultaneously. Some or all of the steps, operations, or processes may be performed automatically, without the intervention of a user. The accompanying method claims, if any, present elements of the various steps, operations or processes in a sample order, and are not meant to be limited to the specific order or hierarchy presented.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112 (f) unless the element is expressly recited using the phrase "means for" or, in the case of a method claim, the element is recited using the phrase "step for." Furthermore, to the extent that the term "include," "have," or the like is used, such term is intended to be inclusive in a manner similar to the term "comprise" as "comprise" is interpreted when employed as a transitional word in a claim.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way.

What is claimed is:

1. A system for producing a strip of pouches, comprising:

a guide device configured to receive a packaging material web, the packaging material web comprising:

a plurality of cover sections extending in a longitudinal direction of the packaging material web and having a transmission of less than 60% in the visible frequency range;

a transparent material area with a transmission of greater than 80% in the visible frequency range extending in the longitudinal direction parallel to the cover sections; and a plurality of data sections;

a printing device configured to apply data to the data sections;

an application device configured to apply an information unit to the cover sections; and a cover section device configured to apply the plurality of cover sections to the packaging material web.

2. The system of claim 1, wherein the guide device is configured so that the data sections are assigned to the printing device and the cover sections are assigned to the application device.

3. The system of claim 1, wherein the guide device comprises a deflection roller.

4. The system of claim 1, further comprising:

a shaping device configured to receive the packaging material web.

5. The system of claim 4, wherein the shaping device is configured to continuously shape in a running direction the packaging material web into a receiving area suitable for receiving small piece goods.

6. The system of claim 5, further comprising:

a joining device configured to join the shaped packaging material web to form a pouch of the strip of pouches.

7. The system of claim 6, further comprising:

a feed device configured to feed drug portions to the pouch.

8. The system of claim 4, further comprising:

a deflection roller configured to feed the packaging material web to the shaping device.

9. The system of claim 1, wherein the printing device and the application device are each arranged downstream of the guide device.

10. The system of claim 1, wherein the strip of pouches comprises a plurality of pouches provided with information over a large area and optimized for an inspection system.

11. The system of claim 1, wherein the printing device is a first printing device, the application device is a second printing device and the cover section device is a third printing device.

12. The system of claim 1, wherein the cover section device is arranged downstream of the guide device, the printing device is arranged downstream of the cover section device and the application device is arranged downstream of the printing device.

13. The system of claim 1, wherein each of the plurality of cover sections is permeable to light in the near infrared range.

14. The system of claim 1, wherein the data section and the cover section are arranged on the same side of the strip of pouches.

15. The system of claim 1, wherein the packaging material web received by the guide device comprises one of:

an inner layer, a carrier layer disposed on the inner layer and a cover layer disposed on a portion of the carrier layer less than the entirety of the carrier layer, the cover layer defining the cover section;

an inner layer, first and second portions of a cover layer disposed on the inner layer, the first portion of the cover layer defining the cover section and a protective layer disposed on the cover layer;

an inner layer and a cover layer disposed on a portion of the inner layer less than the entirety of the inner layer, the cover layer defining the cover section; and a single layer comprising an inner layer portion and a cover layer portion, the cover layer portion defining the cover section.

16. A method for producing a strip of pouches, the method comprising:

receiving, by a guide device, a packaging material web having a transparent material area with a transmission of greater than 80% in the visible frequency range extending in a longitudinal direction;

printing, by a printing device, pouch-specific data onto a first data section of a plurality of data sections of the packaging material web;

applying, by an application device, an information unit to a first cover section of a plurality of cover sections of the packaging material web, the plurality of cover sections extending in the longitudinal direction of the packaging material web and having a transmission of less than 60% in the visible frequency range;

shaping, by a shaping device, a sub-section of the packaging material web into a receiving area, wherein at least a portion of a first cover section and the printed first data section are assigned to the receiving area and the pouch-specific data is arranged on an outside surface of the shaped sub-section; and forming a pouch from the receiving area.

17. The method of claim 16, further comprising one of:

applying the information unit to the first cover section before the receiving area is formed, wherein the information unit is arranged on the outside of the pouch; and obtaining pouch-specific data and applying the information unit to the first cover section based on the obtained pouch-specific data.

18. The method of claim 16, further comprising:

covering the first cover section with a protective layer.

19. The method of claim 16, wherein the packaging material web received by the guide device comprises one of:

an inner layer, a carrier layer disposed on the inner layer and a cover layer disposed on a portion of the carrier layer less than the entirety of the carrier layer, the cover layer defining the cover section;

an inner layer, first and second portions of a cover layer disposed on the inner layer, the first portion of the cover layer defining the cover section and a protective layer disposed on the cover layer;

an inner layer and a cover layer disposed on a portion of the inner layer less than the entirety of the inner layer, the cover layer defining the cover section; and a single layer comprising an inner layer portion and a cover layer portion, the cover layer portion defining the cover section.

* * * * *